US011114801B2

(12) United States Patent
Misu et al.

(10) Patent No.: US 11,114,801 B2
(45) Date of Patent: Sep. 7, 2021

(54) CONNECTOR

(71) Applicant: Sumitomo Wiring Systems, Ltd., Mie (JP)

(72) Inventors: Takeshi Misu, Mie (JP); Masato Kamemura, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/957,703

(22) PCT Filed: Dec. 19, 2018

(86) PCT No.: PCT/JP2018/046742
§ 371 (c)(1),
(2) Date: Jun. 24, 2020

(87) PCT Pub. No.: WO2019/131373
PCT Pub. Date: Jul. 4, 2019

(65) Prior Publication Data

US 2020/0366029 A1 Nov. 19, 2020

(30) Foreign Application Priority Data

Dec. 26, 2017 (JP) ..... JP2017-249635

(51) Int. Cl.
*H01R 13/641* (2006.01)
*H01R 13/639* (2006.01)
*H01R 13/627* (2006.01)

(52) U.S. Cl.
CPC ..... *H01R 13/639* (2013.01); *H01R 13/6275* (2013.01); *H01R 13/641* (2013.01)

(58) Field of Classification Search
CPC . H01R 13/639; H01R 13/641; H01R 13/6275
See application file for complete search history.

(56) References Cited

U.S. PATENT DOCUMENTS 6,468,105 B2 * 10/2002 Noguchi ..... H01R 13/641 439/489
6,572,400 B2 * 6/2003 Noguchi ..... H01R 13/641 439/489

(Continued)

FOREIGN PATENT DOCUMENTS

JP 2005-63751 3/2005
JP 2015-032506 2/2015

(Continued)

OTHER PUBLICATIONS

International Search Report dated Apr. 2, 2019.

*Primary Examiner* — Tho D Ta
(74) *Attorney, Agent, or Firm* — Gerald E. Hespos; Michael J. Porco; Matthew T. Hespos

(57) ABSTRACT

A connector (10) includes a housing (20) and a connection detecting member (60) that is displaceable between a connection assurance position and a connection assurance release position. The connection detecting member (60) is mountable on the housing (20) and pushed from a pre-assembling position to the connection assurance release position. First arms (74) are on sides of the connection detecting member (60). Two first guide grooves (44) and two second guide grooves (48) are in the side walls (42) of the housing (20) and extend along a sliding direction of the connection detecting member. First claws (76) of the first arms (74) are in the first guide grooves (44) at the connection assurance position and the connection assurance release position, and are in the second guide grooves (48) at the pre-assembling position. The first arms (74) deflect by pushing the connection detecting member (60) to the connection assurance release position.

2 Claims, 25 Drawing Sheets

(56) References Cited

U.S. PATENT DOCUMENTS

| | | | | |
|---|---|---|---|---|
| 6,908,329 | B2 * | 6/2005 | Kozono | H01R 13/641 439/352 |
| 7,048,568 | B2 * | 5/2006 | Fisher | H01R 13/641 439/352 |
| 7,108,542 | B2 * | 9/2006 | Ishiwa | H01R 13/641 439/352 |
| 7,252,530 | B2 * | 8/2007 | Shamoto | H01R 13/641 439/352 |
| 7,591,668 | B2 * | 9/2009 | Nakamura | H01R 13/641 439/489 |
| 7,614,904 | B2 * | 11/2009 | Hiramatsu | H01R 13/641 439/352 |
| 7,806,715 | B2 * | 10/2010 | Zheng | H01R 13/641 439/352 |
| 2015/0037988 | A1 | 2/2015 | Katoaka et al. | |

FOREIGN PATENT DOCUMENTS

| | | |
|---|---|---|
| JP | 2015-50103 | 3/2015 |
| JP | 2017-91761 | 5/2017 |
| JP | 2017-157546 | 9/2017 |

* cited by examiner

CONNECTOR

BACKGROUND

Field of the Invention

This specification relates to a connector.

Related Art

Japanese Unexamined Patent Publication No. 2017-91761 discloses a connector that includes a female connector housing and a connection detecting member to be assembled with the connector housing. The connection detecting member is a functional member for realizing a so-called CPA (Connector Position Assurance) and detects that the connector and a mating connector are connected completely and mounted in a holding chamber of the connector housing.

Two guide walls are formed in a width direction of the holding chamber of the connector housing, and each of the guide walls is provided with a recess for guiding the connection detecting member along a connecting direction. The connection detecting member is provided with two protrusions projecting outward in the width direction, and the protrusions are inserted into the recesses provided in the guide walls.

However, the holding chamber of the connector housing is not provided with a guide for inserting the connection detecting member into the recesses. Thus, it is difficult to align the protrusions with the recesses and there is a problem that the assembling workability of the connection detecting member with the connector housing is poor.

SUMMARY

A connector disclosed in this specification has a housing to be connected to a mating housing, and a separate connection detecting member slidably mounted on the housing for connection assurance of the housing and the mating housing. The connection detecting member is relatively displaceable between a connection assurance position where connection assurance of the housing and the mating housing is made and a connection assurance release position where the connection assurance is released. The connection detecting member is mountable on the housing by being pushed and displaced from a pre-assembling position before assembling is performed to the connection assurance release position in mounting the connection detecting member on the housing. Two flexible arm are provided on both sides of the connection detecting member. The housing is provided with two side walls spaced apart in a direction intersecting a sliding direction of the connection detecting member and extending parallel to the sliding direction of the connection detecting member. Two first guide grooves along the sliding direction of the connection detecting member and two second guide grooves parallel to the first guide grooves and disposed forward of the first guide grooves in a pushing direction of the connection detecting member are provided in the side walls. Tips of the arms are in the first guide grooves at the connection assurance position and the connection assurance release position, and the tips of the arms are in the second guide grooves at the pre-assembling position. The arms are deflected by pushing the connection detecting member, and the connection detecting member is displaced to the connection assurance release position Since the connection detecting member is assembled by being displaced from the pre-assembling position to the connection assurance release position, assembling workability can be improved as compared to the case where the connection detecting member is mounted directly at the connection assurance release position as before.

Further, the housing may be provided with a housing-side contact surface to be brought into contact with the connection detecting member at the connection assurance release position, and the connection detecting member may come into contact with the housing-side contact surface to be positioned at the connection assurance release position when being displaced from the pre-assembling position to the connection assurance release position. Thus, the connection detecting member can be mounted reliably on the housing.

According to the connector disclosed in this specification, it is possible to improve the assembling workability of the connection detecting member.

DETAILED DESCRIPTION

An embodiment is described with reference to FIGS. 1 to 25.

Figure 1:
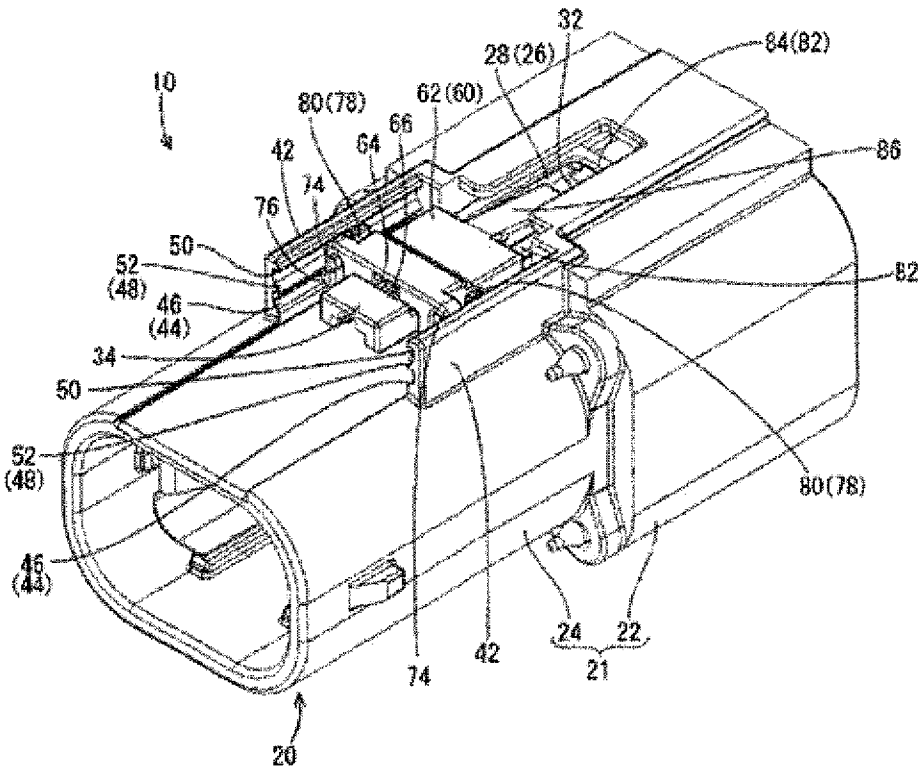
FIG. 1 is a rear perspective view of a connector in an embodiment.
Figure 4:
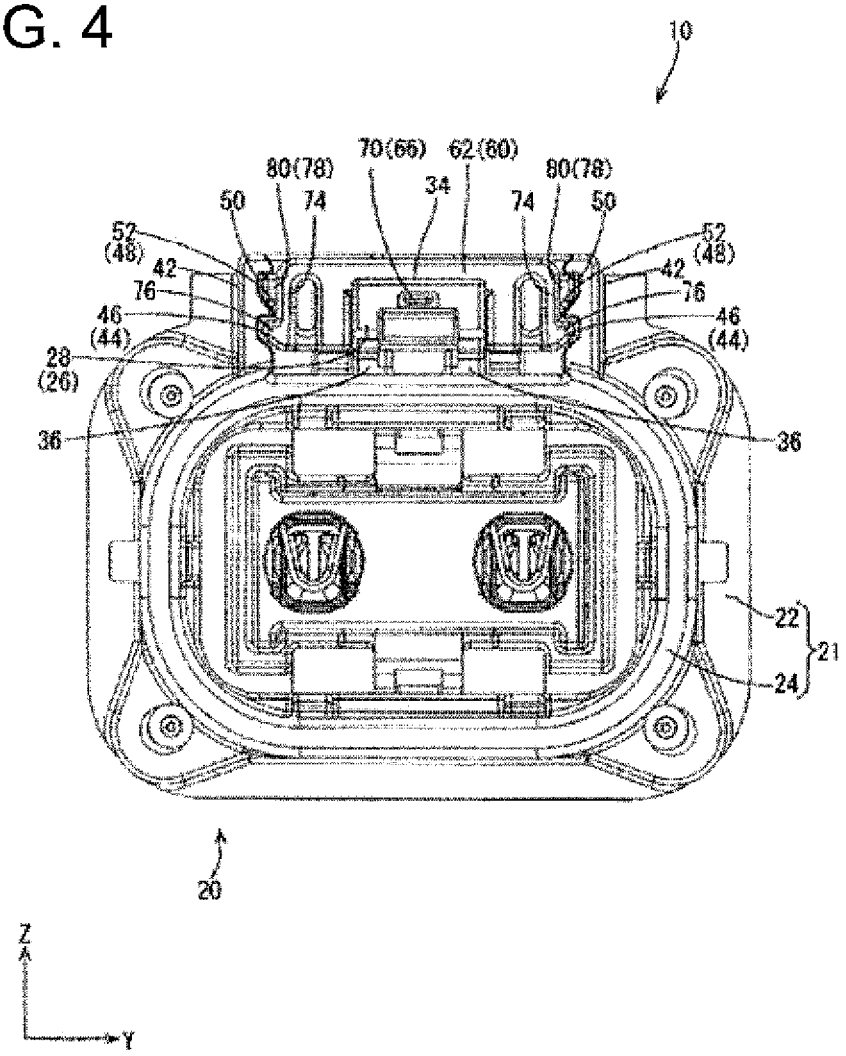
FIG. 4 is a back view of the connector.
Figure 5:
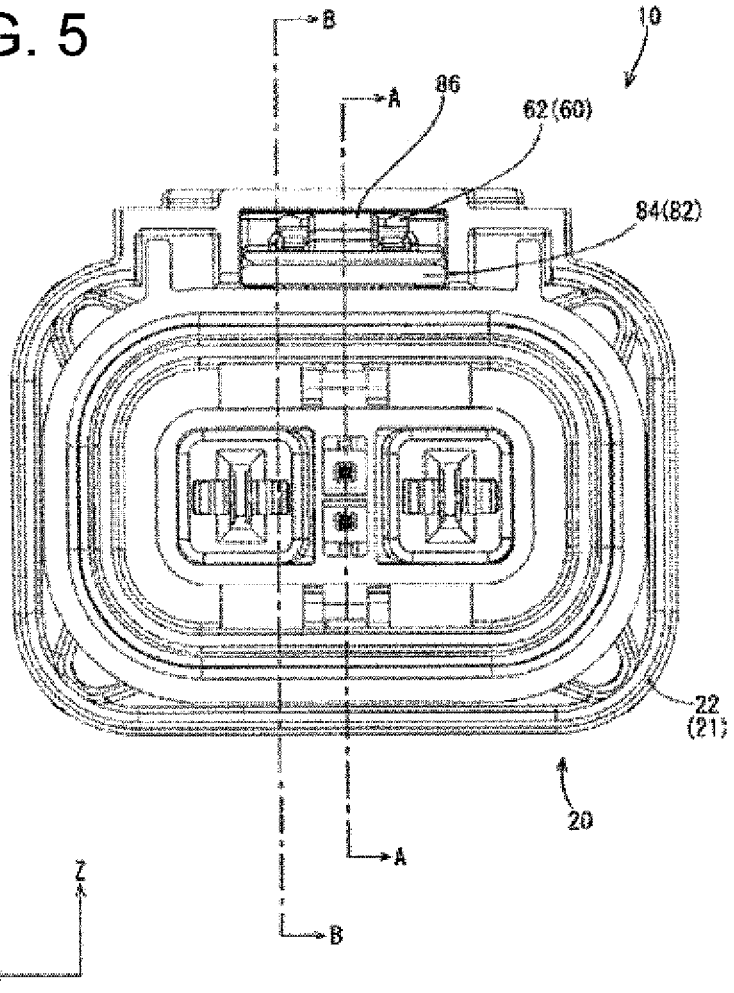
FIG. 5 is a front view of the connector.
Figure 14:
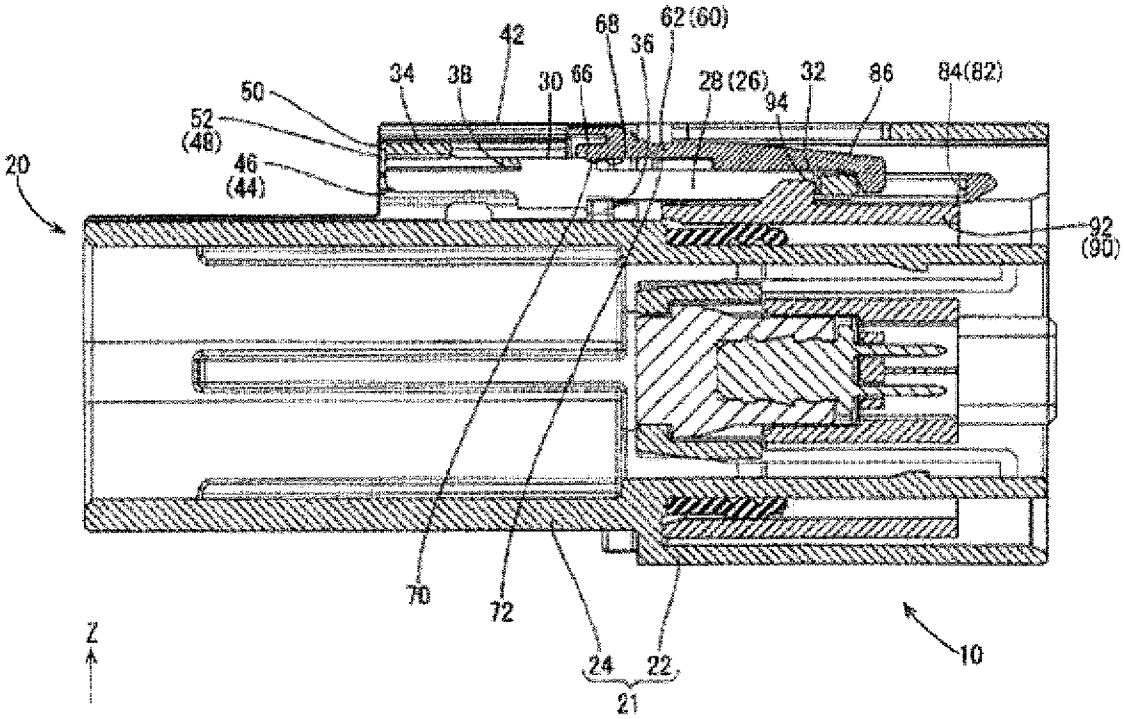
FIG. 14 is a section along A-A of FIG. 5 in a state where the connection detecting member is at a connection assurance position.

A connector 10 of this embodiment includes a female housing 20 and a connection detecting member 60 to be slidably mounted on the housing 20, as shown in FIG. 1. As shown in FIG. 14, the housing 20 is connected to a male mating housing 90. In the following description, a Z direction and a Y direction of FIG. 4 are referred to as an upward direction and a rightward direction, and a connecting direction of the housing 20 and the mating housing 90 is referred to as a forward direction.

Figure 6:
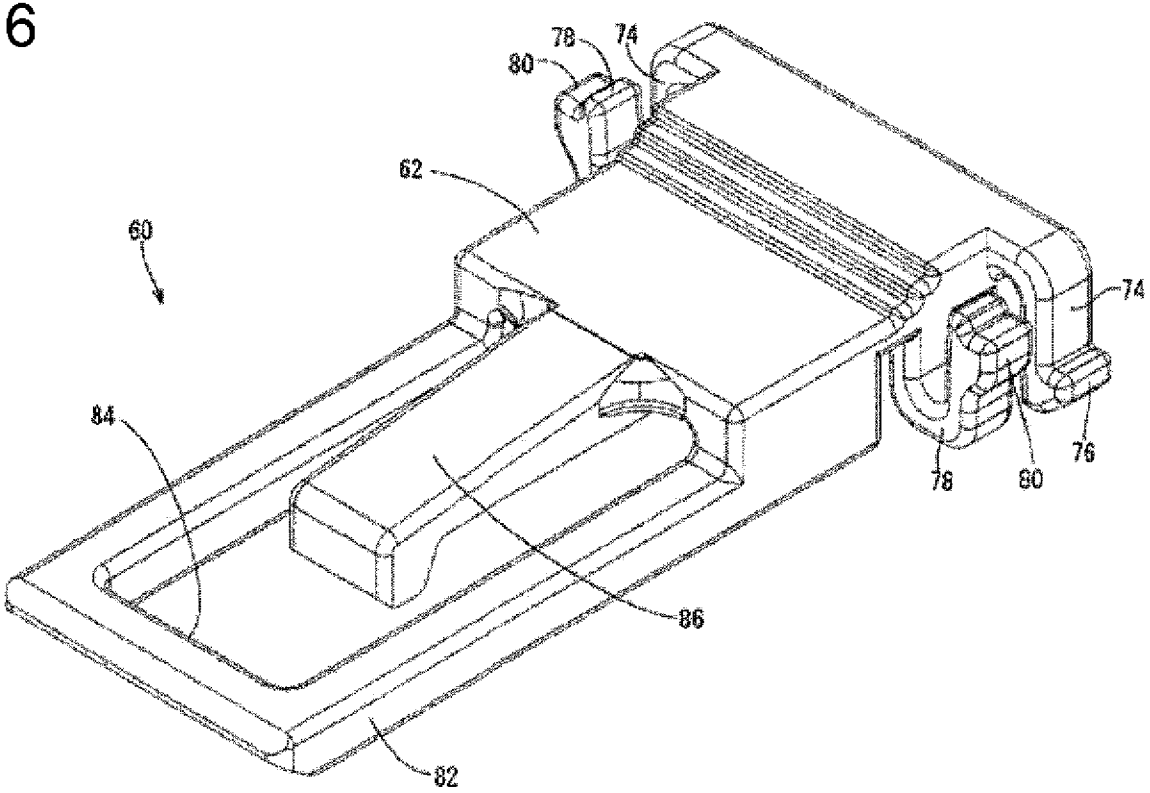
FIG. 6 is a front perspective view of a connection detecting member.

The connection detecting member 60 is for connection assurance by detecting that the housing 20 and the mating housing 90 are connected properly and is a functional member for realizing a so-called CPA (Connector Position Assurance). As shown in FIG. 6, the connection detecting member 60 includes a detecting member body 62 in the form of a rectangular plate. A frame-like latch 82 projects forward from the front end of the detecting member body 62, and a connection detecting portion 86 is cantilevered from the front end of the detecting member body 62. The front end surface in the frame of the latch 82 serves as a later-described latch lock 84 that contacts a mating lock portion 94 of the mating housing 90 while connection is being released.

Figure 7:
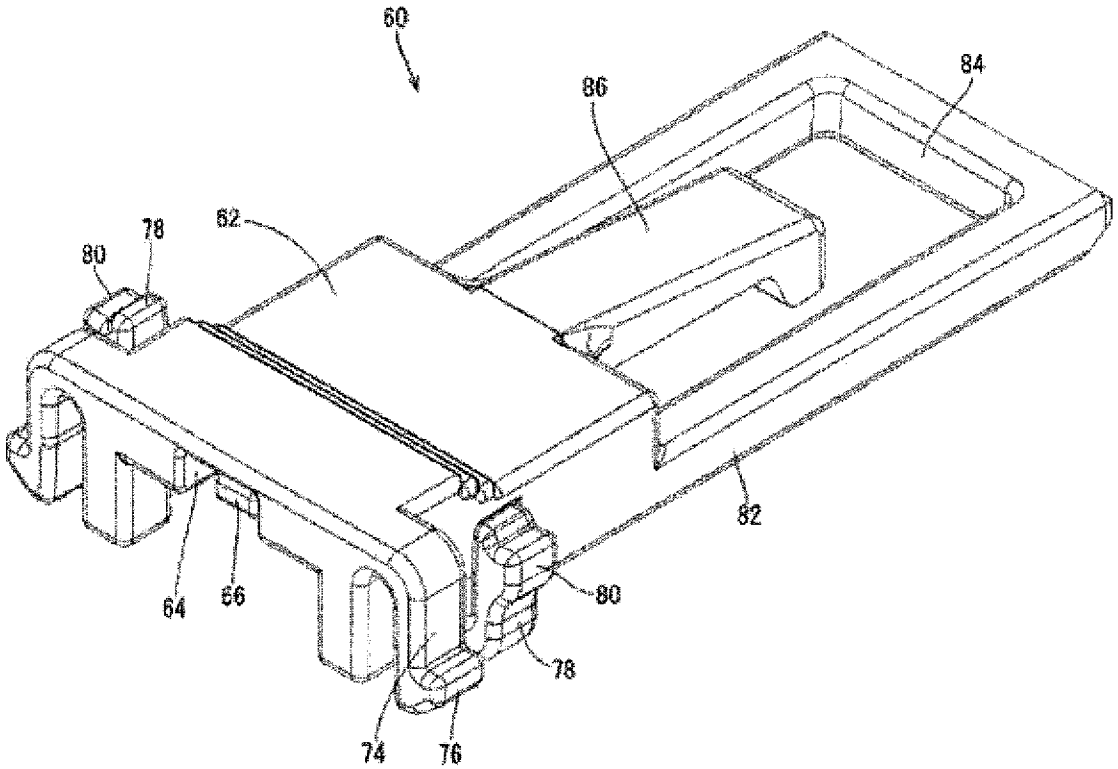
FIG. 7 is a rear perspective view of the connection detecting member.

As shown in FIGS. 6 and 7, two flexible first arms 74 and two flexible second arms 78 disposed in front of the first arms 74 are provided on both left and right sides of the detecting member body 62.

As shown in FIGS. 6 and 7, the first arms 74 are cantilevered down from the both sides of the detecting member body 62, and first claws 76 project laterally out on tips of the first arms 74.

As shown in FIGS. 6 and 7, the second arms 78 project down from the both sides of the detecting member body 62 and are folded to project up. Further, second claws 80 project laterally out on tip parts of the second arms 78.

Figure 8:
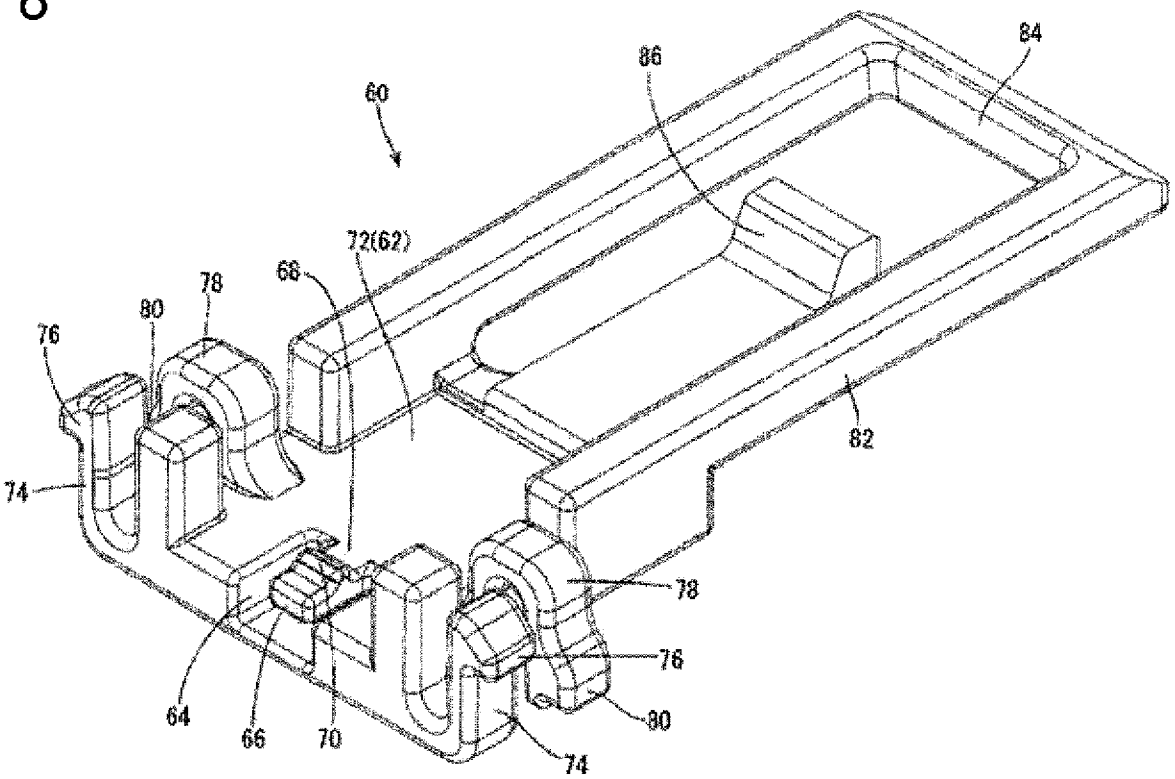
FIG. 8 is an underside perspective view of the connection detecting member.

As shown in FIG. 8, a locking lance accommodation groove 64 is open in a rear part of the lower surface of the detecting member body 62, and a locking lance 66 is cantilevered rearward from the front inner wall of the locking lance accommodation groove 64. The locking lance 66 is flexible and resiliently displaceable in a vertical direction. The lower surface of the locking lance 66 serves as a sliding surface 68 that slides against the housing 20 to be described later, and a projection 70 projects down from the sliding surface 68.

Figure 9:
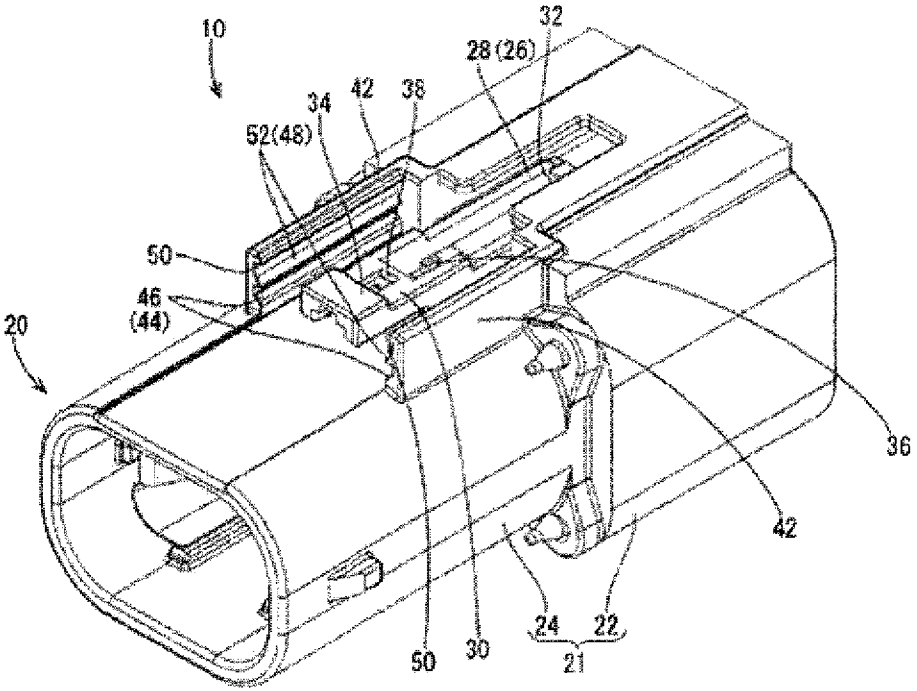
FIG. 9 is a rear perspective view of a housing.
Figure 10:
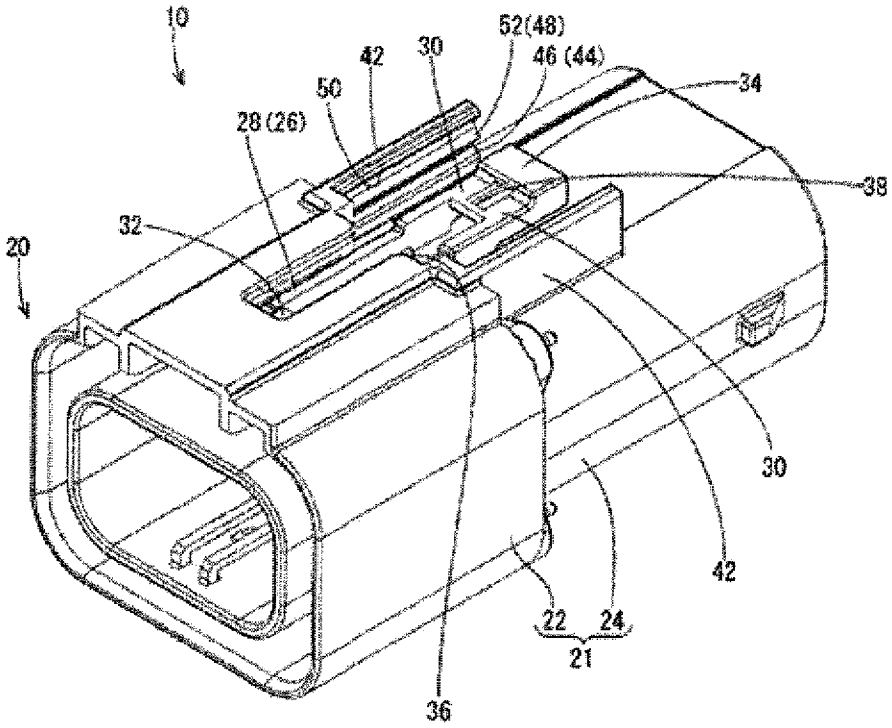
FIG. 10 is a front perspective view of the housing.

As shown in FIGS. 9 and 10, the housing 20 includes a receptacle 21 open forward and rearward. A lock arm 26 is provided on the upper surface of the receptacle 21 and left and right side walls 42 are provided on the upper surface of the receptacle 21.

Figure 2:
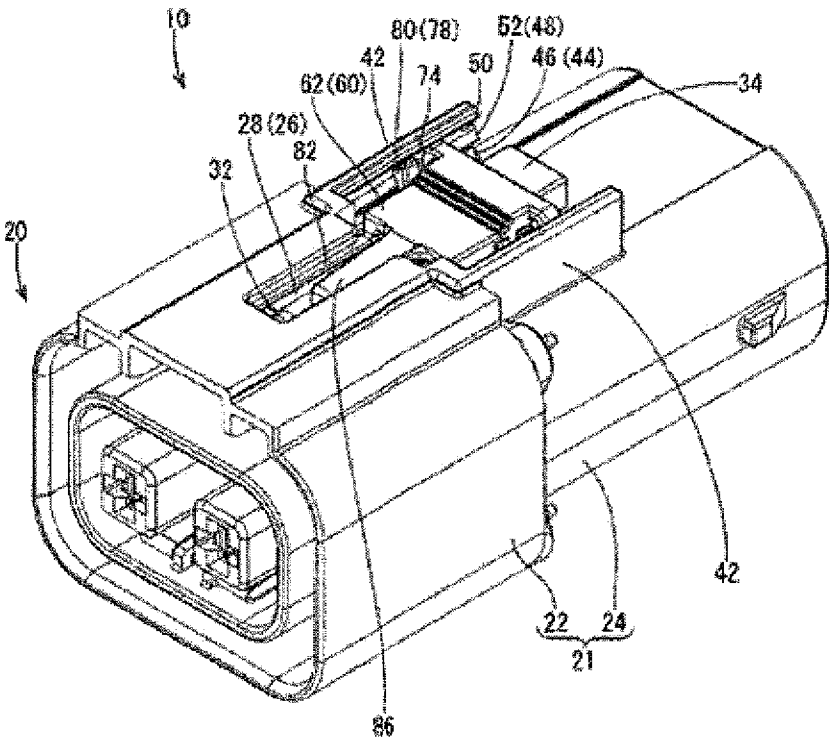
FIG. 2 is a front perspective view of the connector.
Figure 3:
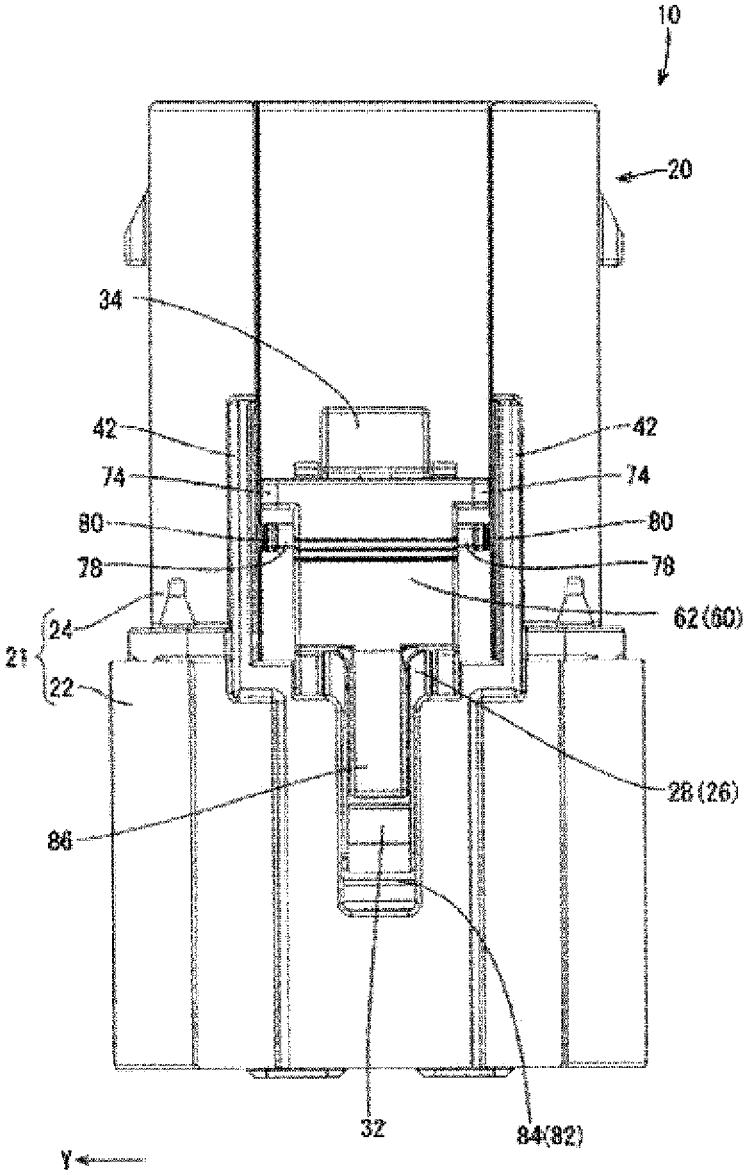
FIG. 3 is a plan view of the connector.

As shown in FIGS. 1 and 2, the receptacle 21 is composed of a front receptacle 22 open in a connecting direction and a rear receptacle 24 open in a direction opposite to the connecting direction.

As shown in FIG. 9, the lock arm 26 includes a lock arm body 28 having a rectangular shape long in a front-rear direction and having a frame-like opening. A base end 36 projects down from the lower surface of the lock arm body 28 and is connected to the upper surface of the rear receptacle 24. A rectangular pressing portion 34 is provided in a rear part of the upper surface of the lock arm body 28. If the pressing portion 34 is pressed down with a finger, the lock arm 26 is displaceable in a seesaw manner with the base end 36 as a fulcrum.

As shown in FIG. 9, a locking portion 38 having a rectangular opening is provided immediately in front of the pressing portion 34 of the lock arm body 28. The tip of the frame-like opening of the lock arm body 28 serves as a housing-side lock 32 that comes into contact with the mating lock 94 of the mating housing 90 to be described later. The connection detecting member 60 is mounted slidably on the upper surface of the lock arm body 28.

As shown in FIG. 9, the two side walls 42 project up from the upper surface of the rear receptacle 24 and are disposed laterally to the lock arm 26. Two first guide grooves 44 and two second guide grooves 48 are provided along a sliding direction (front-rear direction) of the connection detecting member 60 in surfaces of the side walls 42 facing each other. The second guide grooves 48 are disposed above the first guide grooves 44. The bottom surfaces of the first guide grooves 44 serve as first tapered surfaces 46 inclined toward the facing first guide grooves 44. Similarly, the bottom surfaces of the second guide grooves 48 serve as second tapered surfaces 52 inclined toward the facing second guide grooves 48.

Figure 11:
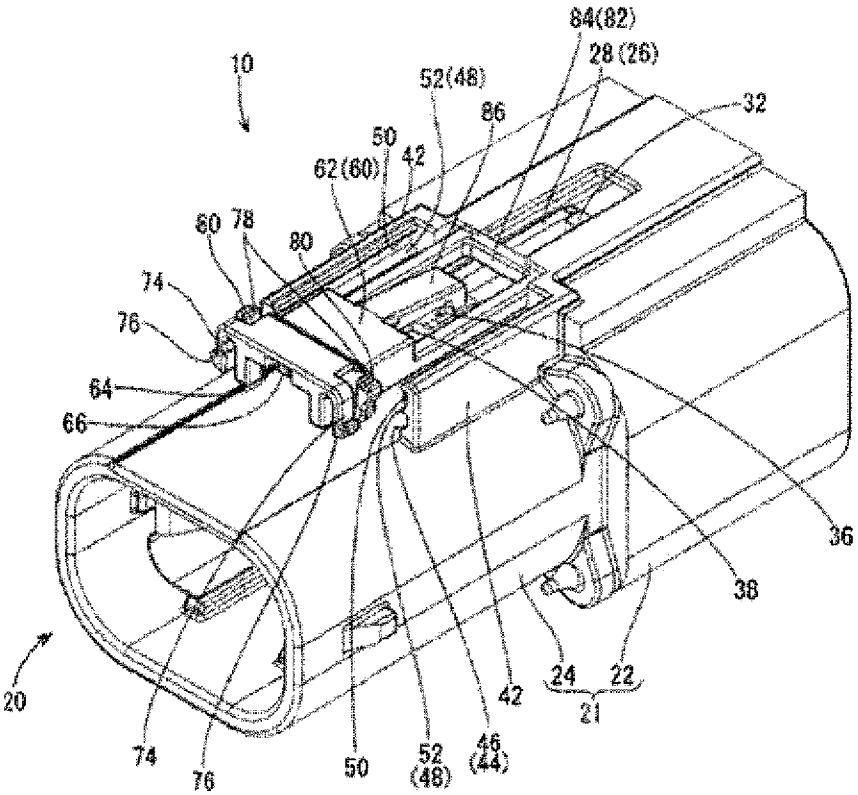
FIG. 11 is a perspective view before the connection detecting member is mounted on the housing.
Figure 12:
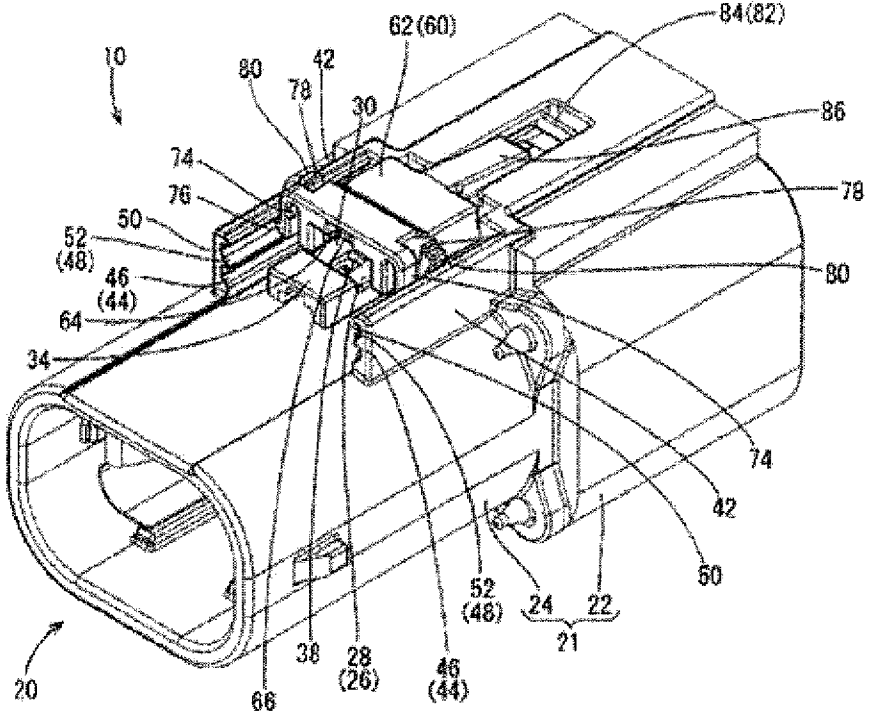
FIG. 12 is a perspective view in a state where the connection detecting member is at a pre-assembling position.
Figure 13:
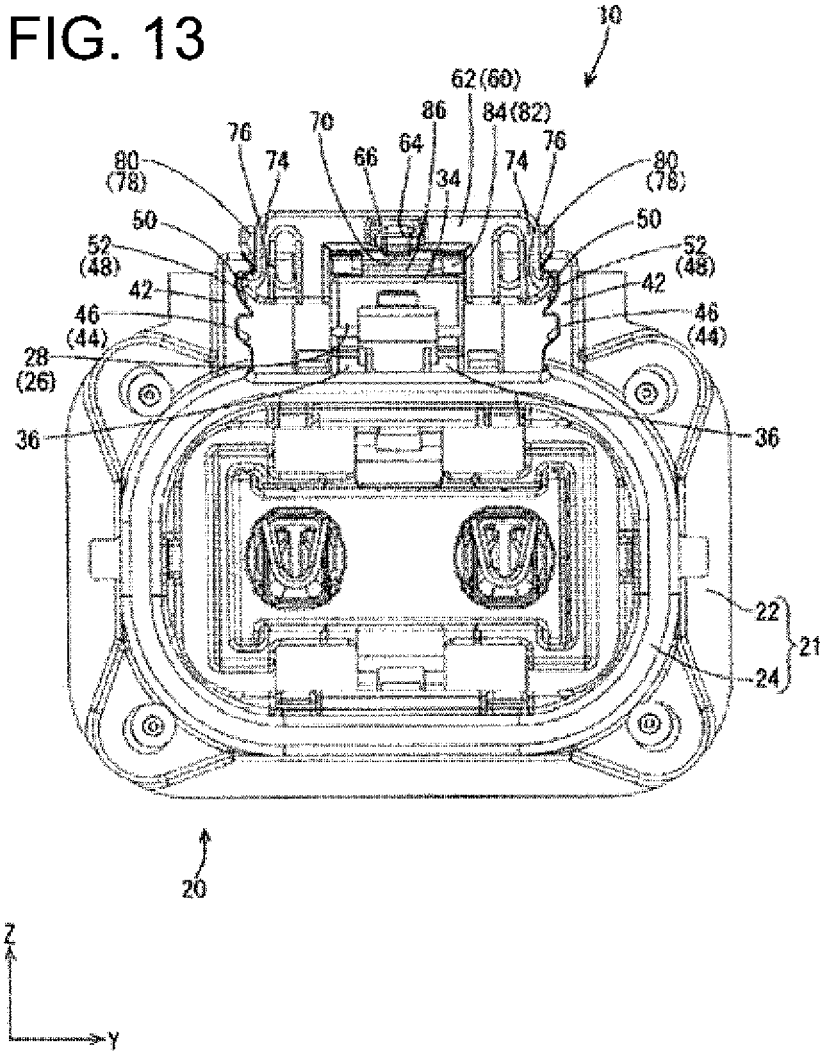
FIG. 13 is a back view in the state where the connection detecting member is at the pre-assembling position.

To mount the connection detecting member 60 on the housing 20, the first claws 76 of the first arms 74 of the connection detecting member 60 are inserted into the second guide grooves 48 of the side walls 42, as shown in FIGS. 11 and 12, and the connection detecting member 60 is mounted at a pre-assembling position shown in FIGS. 12 and 13.

If the detecting member body 62 subsequently is pressed down, the first arms 74 slide against the second tapered surfaces 52 of the second guide grooves 48 to be deflected toward the facing first arms 74. Further, the second arms 78 slide against upper end parts of the side walls 42 to be deflected toward the facing second arms 78. In this way, the first arms 74 come out of the second guide grooves 48 and the lower surface of the pressed detecting member body 62 comes into contact with the upper surface of the lock arm body 28 to stop a downward displacement of the connection detecting member 60, and the connection detecting member 60 is positioned. At this time, as shown in FIG. 4, the deflected first arms 74 are restored and the first claws 76 enter the first guide grooves 44. Further, the deflected second arms 78 are restored and the second claws 80 enter the second guide grooves 48. Further, the projection 70 of the locking lance 66 is located in the locking portion 38 and contacts the inner wall of the locking portion 38 if the connection detecting member 60 is displaced in the connecting direction. Thus, the connection detecting member 60 is locked by the locking portion 38. This position is a later-described connection assurance release position of the connection detecting member 60 shown in FIGS. 1 and 15. In the above way, the connection detecting member 60 can be mounted on the housing 20.

Figure 16:
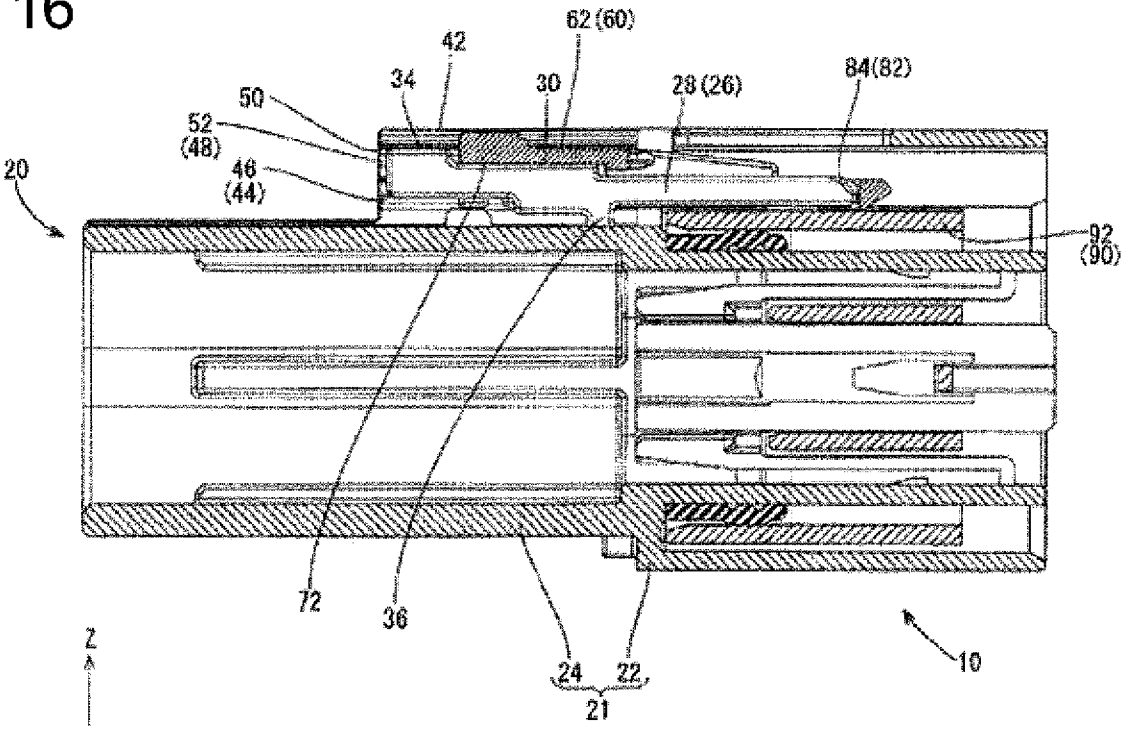
FIG. 16 is a section along B-B of FIG. 5 in the state where the connection detecting member is at the connection assurance release position.
Figure 17:
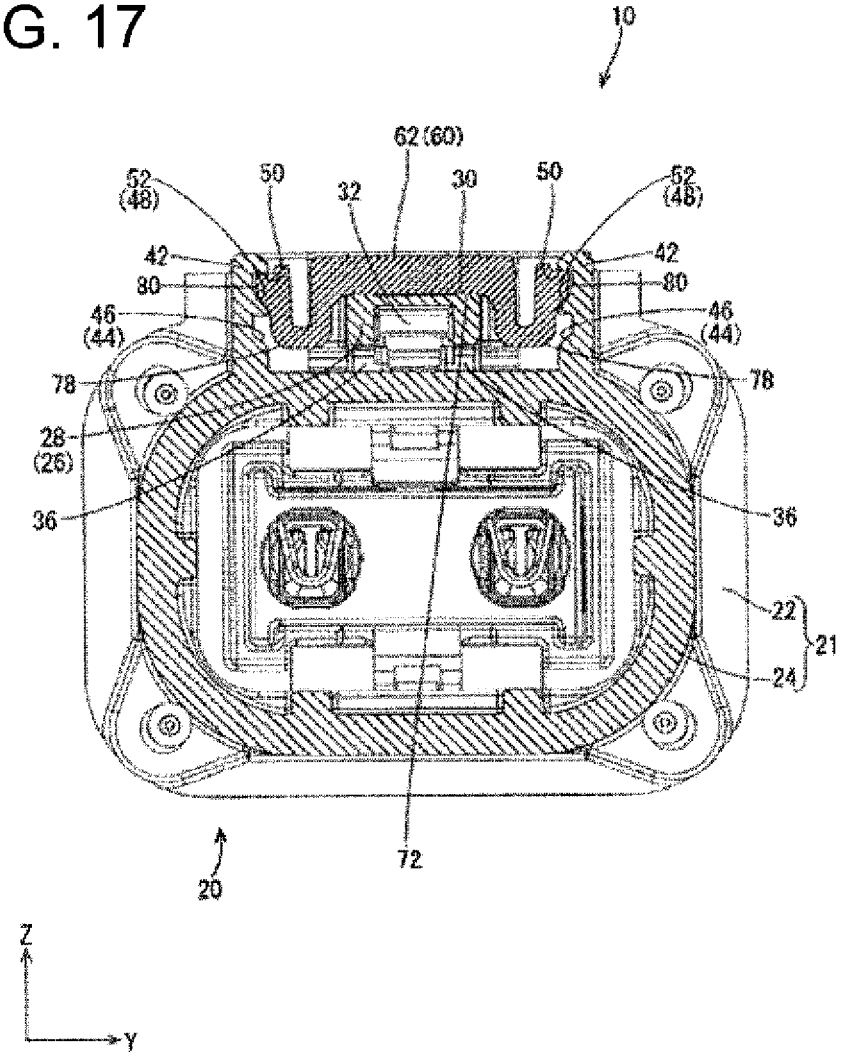
FIG. 17 is a back view in section at the position of second arm portions in the state where the connection detecting member is at the connection assurance release position.

At the connection assurance release position, a housing-side contact surface 30, which is the upper surface of the lock arm body 28 of the housing 20, and a detecting member-side contact surface 72, which is the lower surface of the detecting member body 62 of the connection detecting member 60, are in contact, as shown in FIG. 16. Further, as shown in FIG. 17, the upper surfaces of the second claws 80 of the second arms 78 and arm contact portions 50, which are the ceiling surfaces of the second guide grooves 48 of the housing 20, are in contact. By this arrangement, a vertical displacement of the connection detecting member 60 is restricted and the rattling of the connection detecting member 60 is suppressed since the second arms 78 are in contact with the arm contact portions 50 of the housing 20 in a direction (upward direction) opposite to a direction from the detecting member-side contact surface 72 to the housing-side contact surface 30 (downward direction).

Further, the second claws 80 of the second arms 78 are resiliently in contact with the arm contact portions 50 of the second guide grooves 48, and the detecting member-side contact surface 72 presses the housing-side contact surface 30 by reaction forces from the second claws 80 of the second guide grooves 48. In this way, the housing-side contact surface 30 and the detecting member-side contact surface 72 are held reliably in contact.

Figure 15:
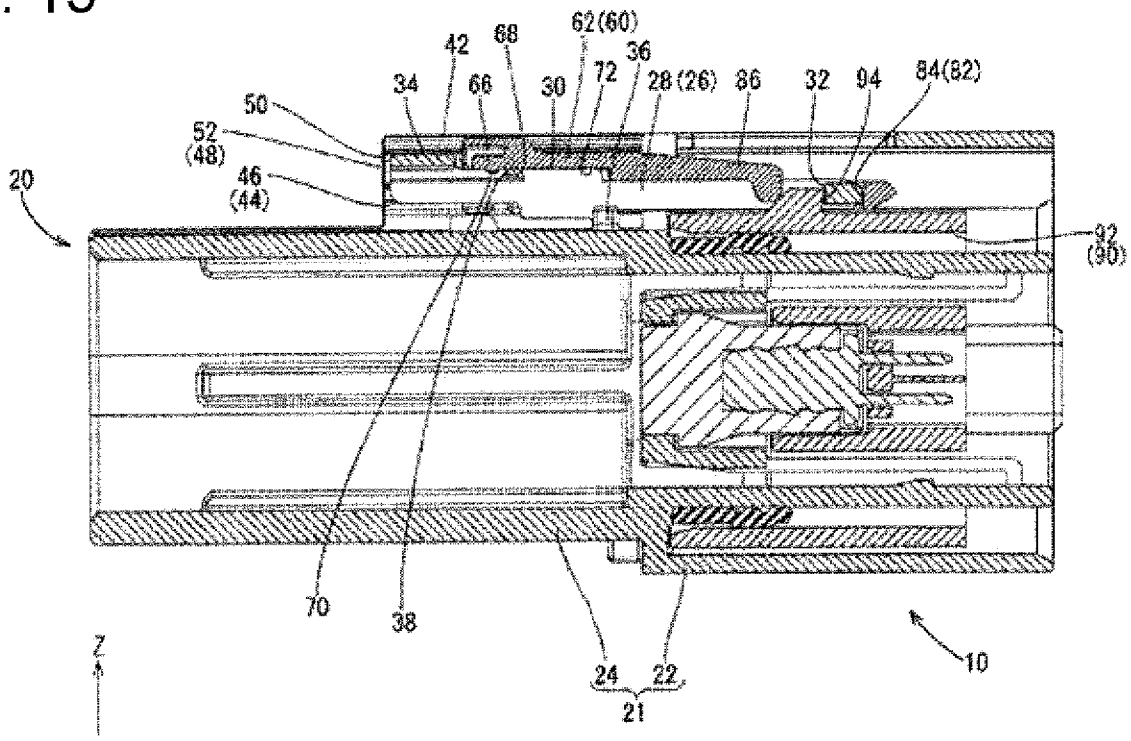
FIG. 15 is a section along A-A of FIG. 5 in a state where the connection detecting member is at a connection assurance release position.

As shown in FIG. 15, the mating housing 90 includes a mating receptacle 92 open in the connecting direction and the mating lock 94 projecting up from the upper surface of the mating receptacle 92.

If the housing 20 and the mating housing 90 are connected, the mating lock 94 is located forward of the housing-side lock 32 and the latch lock 84 in the connecting direction when viewed from the side of the housing 20, as shown in FIG. 15. In separating the mating housing 90 from the housing 20, the locking of the mating lock 94 and the housing-side lock 32 is first released in a first action and, subsequently, the locking of the mating lock 94 and the latch lock 84 is released in a second action. In this way, the mating housing 90 is separated in two actions.

If the connection detecting member 60 is slid in the connecting direction with the housing 20 and the mating housing 90 connected and the connection detecting member 60 located at the connection assurance release position shown in FIG. 15, the projection 70 of the locking lance 66 is displaced resiliently up while coming into contact with and sliding against the inner wall of the locking portion 38. Thus, the projection 70 rides on the locking portion 38. The locking lance 66 is displaced resiliently if the projection 70 rides over the locking portion 38 in this way. Thus, a stress applied to the projection 70 when the projection 70 comes into contact with the inner wall of the locking portion 38 is reduced, and the projection 70 can be prevented from being scraped by repeatedly riding on the locking portion 38.

If the connection detecting member 60 is slid farther in the connecting direction, a tip of the connection detecting portion 86 rides over the mating lock 94 and the housing-side lock 32, as shown in FIG. 14. This position of the connection detecting member 60 is a connection assurance position. Further, when the connection detecting member 60 is slid, the second claws 80 of the second arms 78 slide against the arm contact portions 50 of the second guide grooves 48 and the second arm portions 78 are deflected in directions facing each other. In this way, the connection detecting member 60 can be slid smoothly.

With the housing 20 and the mating housing 90 properly connected, the connection detecting member 60 can be displaced from the connection assurance release position shown in FIG. 15 to the connection assurance position shown in FIG. 14. On the other hand, in a state where the housings are not connected properly, the connection detecting member 60 cannot be displaced to the connection assurance position. For example, if the mating lock 94 is located below the housing-side lock 32, the connection detecting portion 86 comes into contact with the housing-side lock 32 even if the connection detecting member 60 is slid in the connecting direction. Thus, the connection detecting member 60 cannot be displaced to the connection assurance position.

The procedure of releasing the connection of the housing 20 and the mating housing 90 with the connection detecting member 60 located at the connection assurance position is described.

Figure 18:
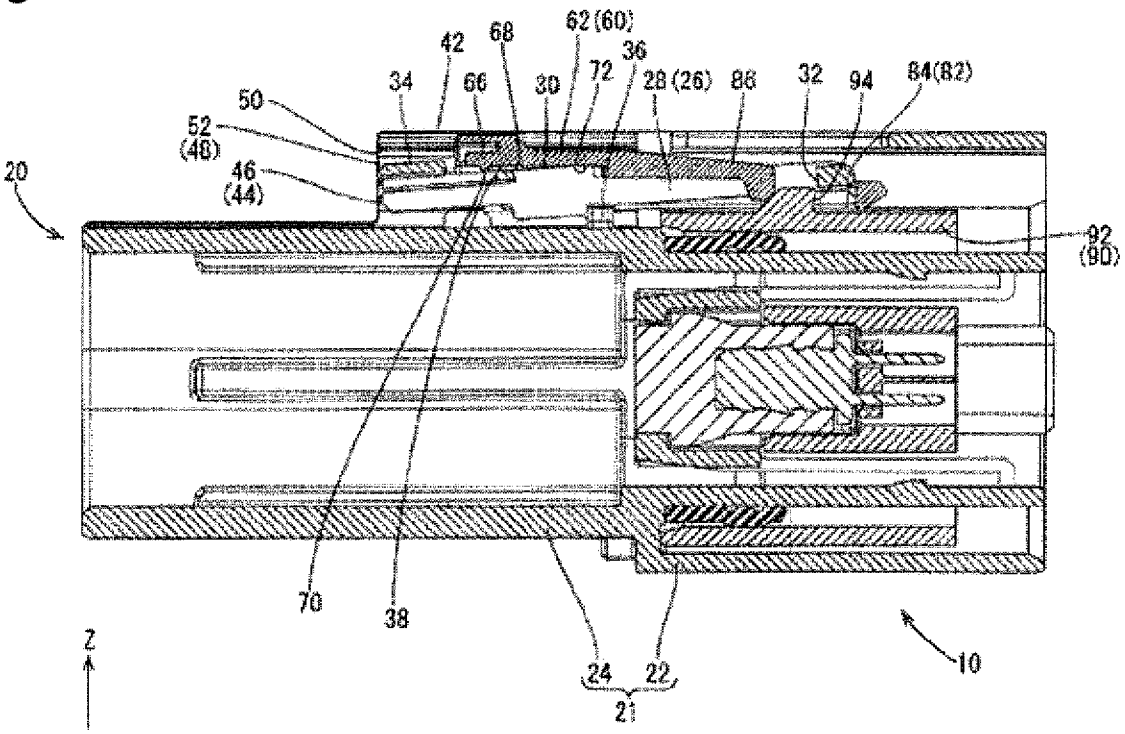
FIG. 18 is a section along A-A of FIG. 5 during a separating operation in a first action.
Figure 19:
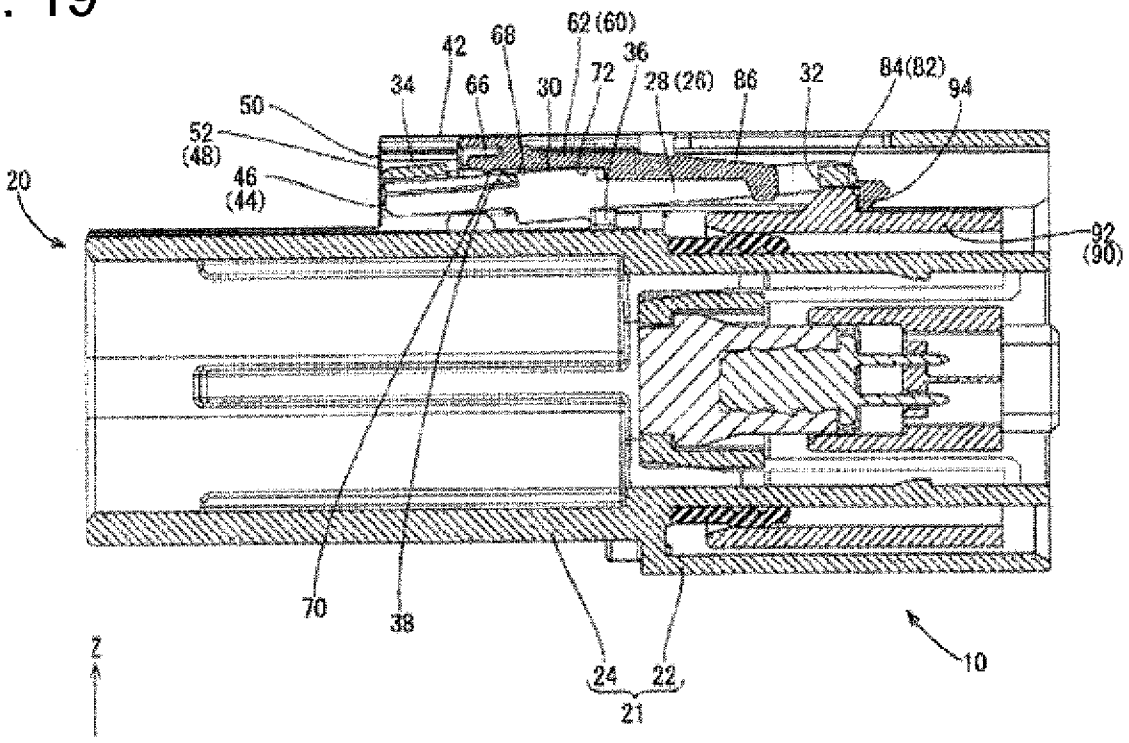
FIG. 19 is a section along A-A of FIG. 5 during the separating operation in the first action.
Figure 20:
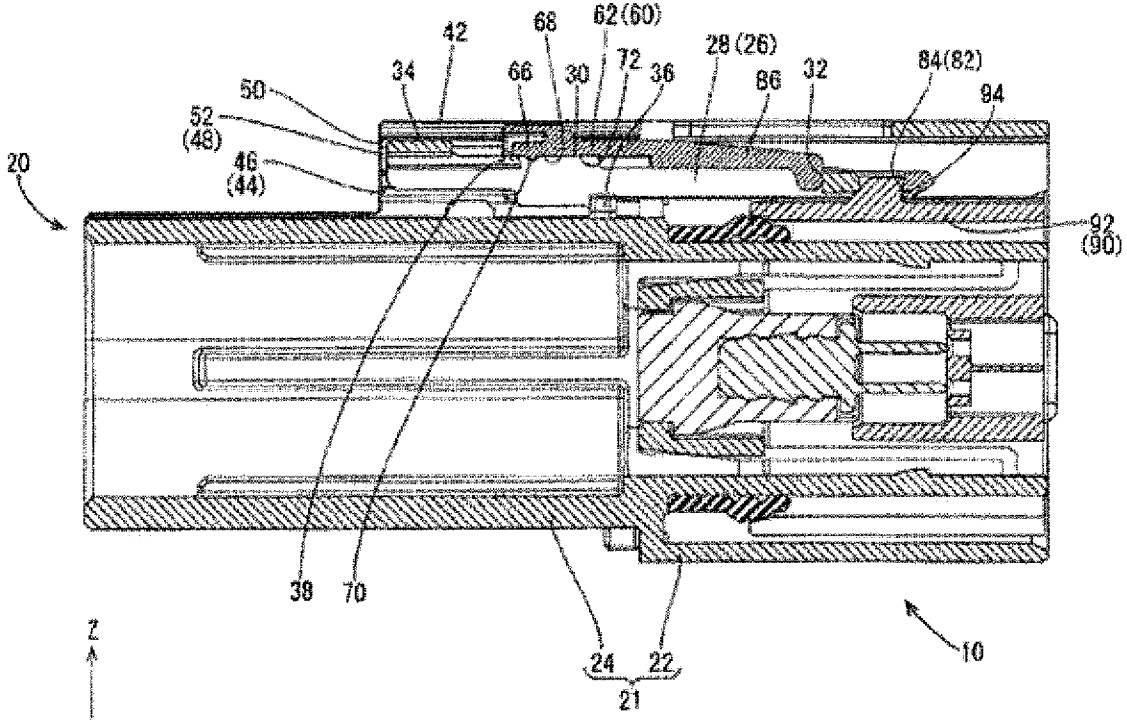
FIG. 20 is a section along A-A of FIG. 5 after the completion of the separating operation in the first action.

First, the connection detecting member 60 at the connection assurance position shown in FIG. 14 is pulled in the direction opposite to the connecting direction and is set at the connection assurance release position shown in FIG. 15. If the pressing portion 34 of the lock arm 26 subsequently is pressed down, the housing-side lock 32 is displaced up, as shown in FIG. 18. If the mating housing 90 subsequently is pulled in the direction opposite to the connecting direction, the mating lock 94 comes into contact with the latch lock 84, as shown in FIG. 19. If the mating housing 90 subsequently is pulled farther in the direction opposite to the connecting direction, the mating lock portion 94 pulls the latch lock 84, and the connection detecting member 60 also is displaced in the same direction as the mating housing 90. In this way, the mating lock 94 is located between the housing-side lock 32 and the latch lock 84, as shown in FIG. 20, and the separation of the mating housing 90 in the first action is completed.

Figure 21:
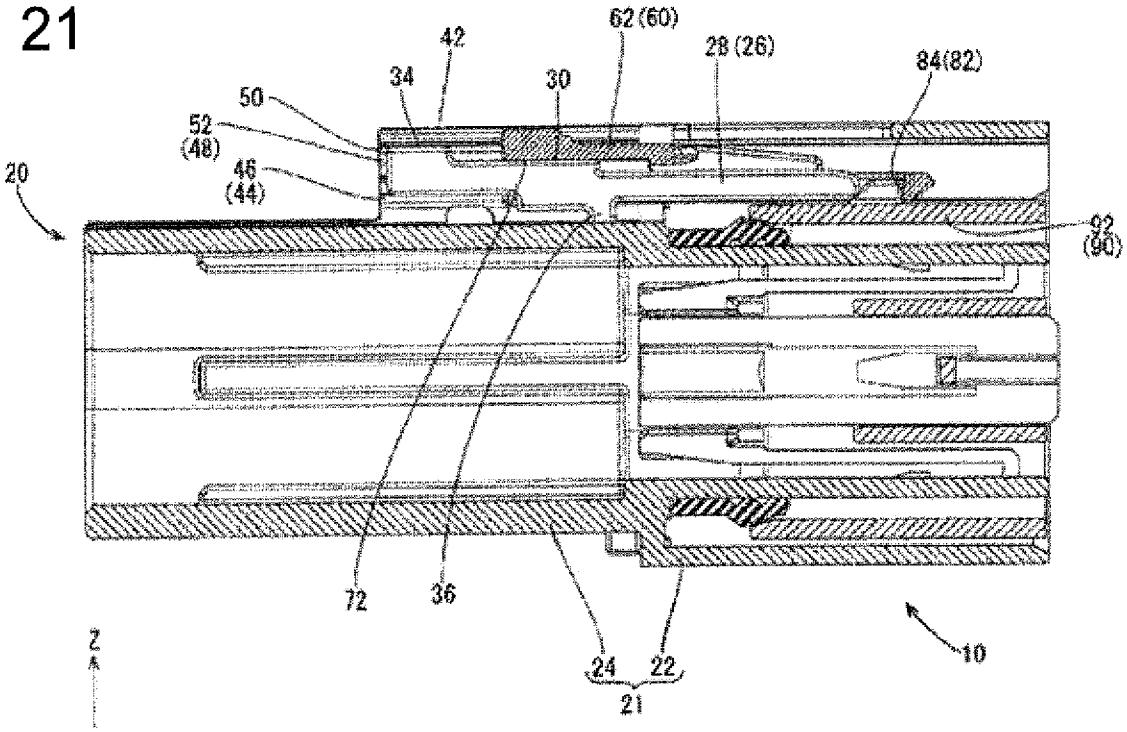
FIG. 21 is a section along B-B of FIG. 5 after the completion of the separating operation in the first action.
Figure 22:
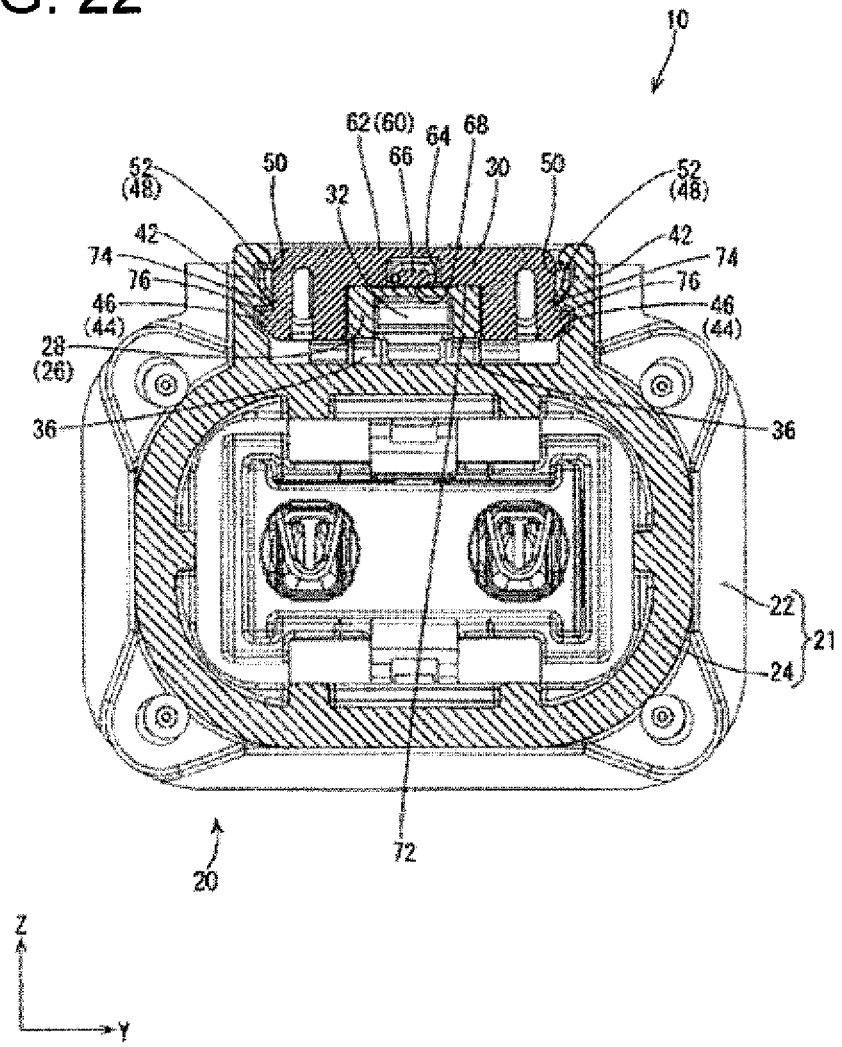
FIG. 22 is a back view in section at the position of the second arm portions after the completion of the separating operation in the first action.

Also, when the separation in the first action is completed, the housing-side contact surface 30 and the detecting member-side contact surface 72 are in contact, as shown in FIG. 21, as at the connection assurance release position. Further, as shown in FIG. 22, the upper surfaces of the second claws 80 of the connection detecting member 60 and the arm contact portions 50, which are the ceiling surfaces of the second guide grooves 48 of the housing 20, are in contact. In this way, vertical rattling of the connection detecting member 60 is suppressed when the separation in the first action is completed. Thus, the latch lock 84 cannot be displaced up and the mating housing 90 is separated without the separating operation by the rattling of the connection detecting member 60.

Figure 23:
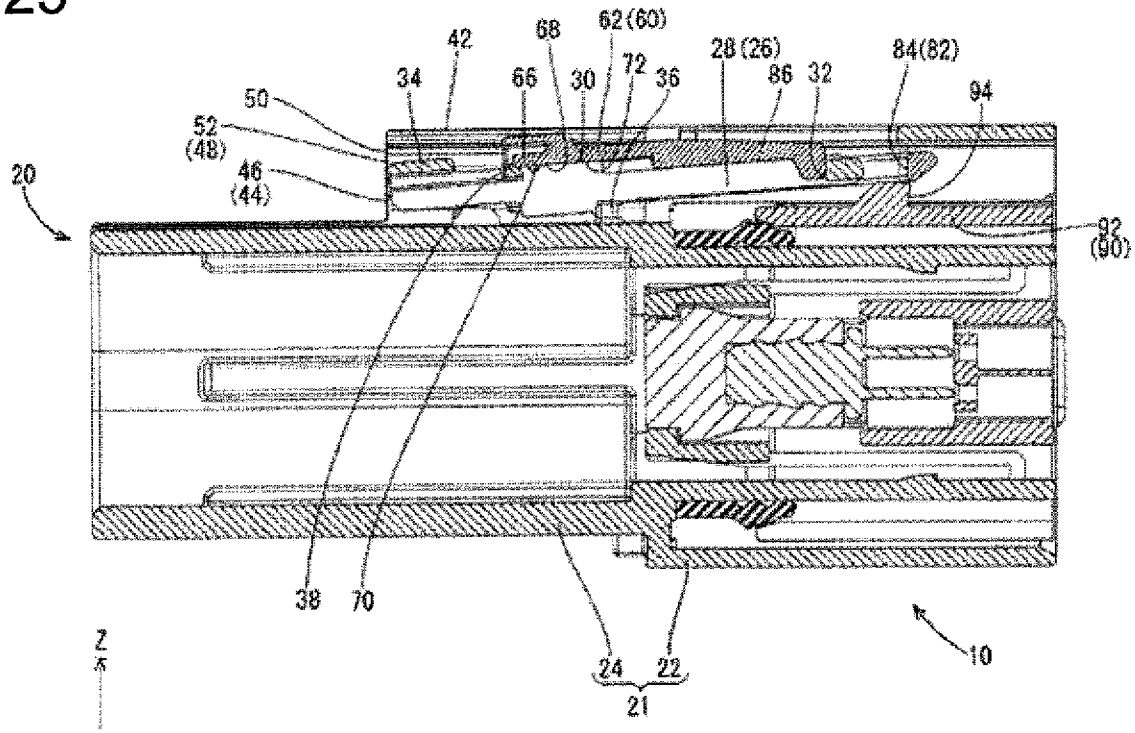
FIG. 23 is a section along A-A of FIG. 5 during a separating operation in a second action.
Figure 24:
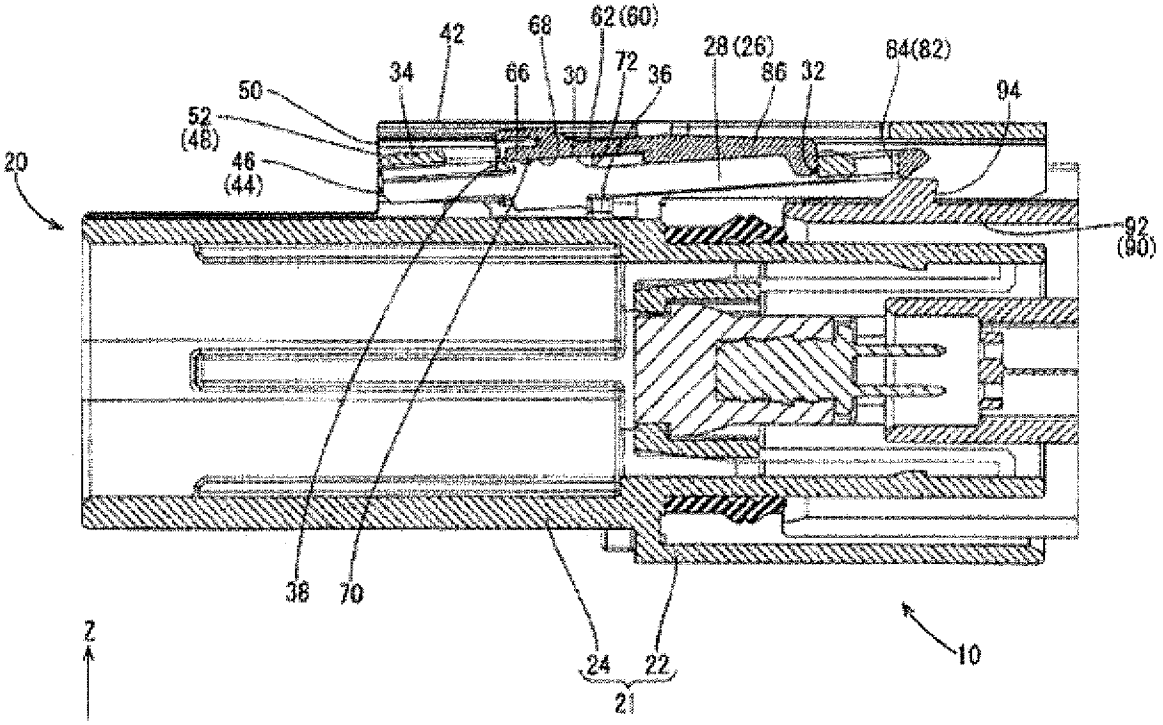
FIG. 24 is a section along A-A of FIG. 5 during the separating operation in the second action.
Figure 25:
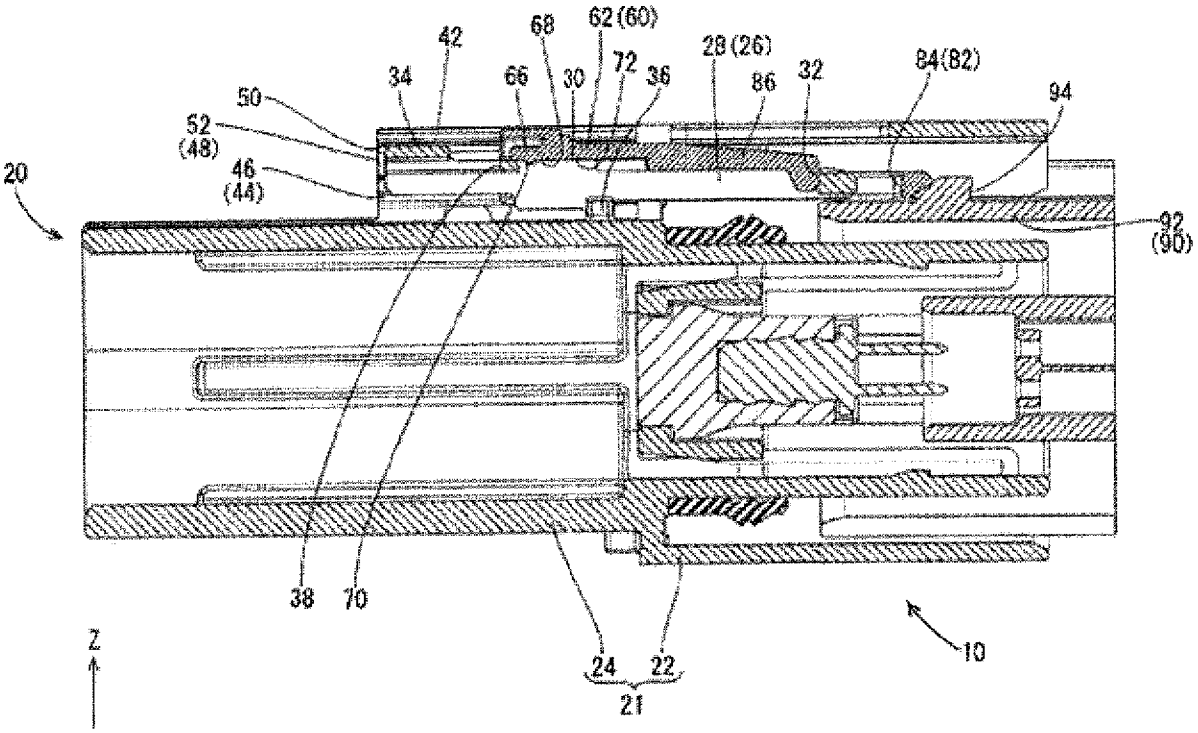
FIG. 25 is a section along A-A of FIG. 5 after the completion of the separating operation in the second action.

Subsequently, if the pressing portion 34 of the lock arm 26 is pressed, the latch lock 84 of the connection detecting member 60 also is displaced up together with the housing-side lock 32, as shown in FIG. 23. Subsequently, if the mating housing 90 is pulled in the direction opposite to the connecting direction, as shown in FIGS. 24 and 25, the separation of the mating housing 90 in the second action is completed.

As described above, according to this embodiment, since the connection detecting member 60 is assembled by being displaced from the pre-assembling position to the connection assurance release position, assembling workability can be improved as compared to the case where the connection detecting member 60 is directly mounted at the connection assurance release position as before.

Further, since the connection detecting member 60 comes into contact with the housing-side contact surface 30 to be positioned when being pushed and displaced from the pre-assembling position to the connection assurance release position, the connection detecting member 60 can be mounted reliably on the housing 20.

The technique disclosed by this specification is not limited to the above described and illustrated embodiment. For example, the following various modes are also included.

Although the locking lance 66 is cantilevered rearward from the front inner wall of the locking lance accommodation groove 64 in the above embodiment, a locking lance may be cantilevered forward from the rear surface of a locking lance accommodation groove.

Although the connection detecting member 60 includes the latch 82 and the connection detecting portion 86 in the above embodiment, a connection detecting member may include no latch.

Although the second claws 80 of the second arms 78 are configured to resiliently contact the arm contact portions 50 of the second guide grooves 48 in the above embodiment, the second claws 80 of the second arms 78 may not be in contact with the arm contact portions 50 of the second guide grooves 48.

LIST OF REFERENCE SIGNS

10 . . . connector
20 . . . housing
30 . . . housing-side contact surface
42 . . . side wall
44 . . . first guide groove
48 . . . second guide groove
60 . . . connection detecting member
74 . . . first arm portion
76 . . . first claw portion (tip part)
90 . . . mating housing

The invention claimed is:

1. A connector, comprising:

a housing to be connected to a mating housing; and a separate connection detecting member to be slidably mounted on the housing for connection assurance of the housing and the mating housing, wherein:

the connection detecting member is relatively displaceable between a connection assurance position where connection assurance of the housing and the mating housing is made and a connection assurance release position where the connection assurance is released, the connection detecting member is mountable on the housing by being pushed and displaced from a pre-assembling position before assembling is performed to the connection assurance release position in mounting the connection detecting member on the housing, flexible arms are provided on both side parts of the connection detecting member, the housing is provided with two side walls spaced apart in a direction intersecting a sliding direction of the connection detecting member and extending parallel to the sliding direction of the connection detecting member, two first guide grooves along the sliding direction of the connection detecting member and two second guide grooves parallel to the first guide grooves and disposed above the first guide grooves are provided respectively in the side walls, tip of the arms are in the first guide grooves at the connection assurance position and the connection assurance release position and the tip of the arms are in the second guide grooves at the pre-assembling position, and the arms are deflected by pushing the connection detecting member, and the connection detecting member is displaced to the connection assurance release position when the connection detecting member is displaced from the pre-assembling position to the connection assurance release position.

2. The connector of claim 1, wherein:

the housing is provided with a housing-side contact surface to be brought into contact with the connection detecting member at the connection assurance release position, and the connection detecting member comes into contact with the housing-side contact surface to be positioned at the connection assurance release position when being displaced from the pre-assembling position to the connection assurance release position.

* * * * *